US006179045B1

(12) United States Patent
Lilleaas

(10) Patent No.: US 6,179,045 B1
(45) Date of Patent: Jan. 30, 2001

(54) METHOD AND A MACHINE FOR TREATMENT OF WATER, ESPECIALLY WHEN PRODUCING ICE, PARTICULARLY ICE CUBES

(76) Inventor: Dag F. Lilleaas, P.O. Box 2503 Solli N-0202, Oslo (NO)

( * ) Notice: Under 35 U.S.C. 154(b), the term of this patent shall be extended for 0 days.

(21) Appl. No.: 09/214,390

(22) PCT Filed: Jul. 4, 1997

(86) PCT No.: PCT/NO97/00173

§ 371 Date: Mar. 16, 1999

§ 102(e) Date: Mar. 16, 1999

(87) PCT Pub. No.: WO98/01713

PCT Pub. Date: Jan. 15, 1998

(30) Foreign Application Priority Data

Apr. 7, 1996 (NO) ..... 962829

(51) Int. Cl.[7] ..... F25B 29/00
(52) U.S. Cl. ..... 165/65; 62/340
(58) Field of Search ..... 165/65; 62/340, 62/342, 347

(56) References Cited

U.S. PATENT DOCUMENTS

| | | | | |
|---|---|---|---|---|
| 3,791,163 | * | 2/1974 | Dickson et al. | 62/347 |
| 3,811,494 | * | 5/1974 | Menzel | 62/342 |
| 3,930,535 | * | 1/1976 | Menzel | 62/342 |
| 4,357,807 | | 11/1982 | Aleksandrow | 62/228 |
| 4,412,420 | | 11/1983 | Patrichi et al. | 60/635 |
| 4,412,429 | | 11/1983 | Kohl | 62/347 |
| 4,416,194 | * | 11/1983 | Kemp | 165/66 |
| 4,542,034 | * | 9/1985 | Aule et al. | 165/66 |
| 5,443,857 | * | 8/1995 | Arph et al. | 165/66 |
| 5,484,538 | | 1/1996 | Woodward | 210/767 |

FOREIGN PATENT DOCUMENTS

| | | |
|---|---|---|
| 25 17 942 | 11/1976 | (DE) . |
| 1 244 831 | 9/1971 | (GB) . |
| 303191 | 6/1998 | (NO) . |
| WO 98/01714 | 1/1998 | (WO) . |

* cited by examiner

*Primary Examiner*—William E. Tapolcai
(74) *Attorney, Agent, or Firm*—Quarles & Brady LLP

(57) ABSTRACT

In a method for treatment of water, especially when freezing water to ice, particularly in the form of ice cubes in a machine, water is passed over a freezing plate with refrigeration elements for cooling and/or forming ice on the plate. The water which has to be cooled or frozen is first exposed to a boiling process, the water either being taken from a store of boiled water and/or passed through a boiling device with heating to a temperature area of the boiling temperature, preferably 80–100° C. in the actual ice making machine. The water is thereby exposed to a combination of boiling and a subsequent cooling effect or freezing. A machine is also described for use with the method.

10 Claims, 3 Drawing Sheets

Figure 1:
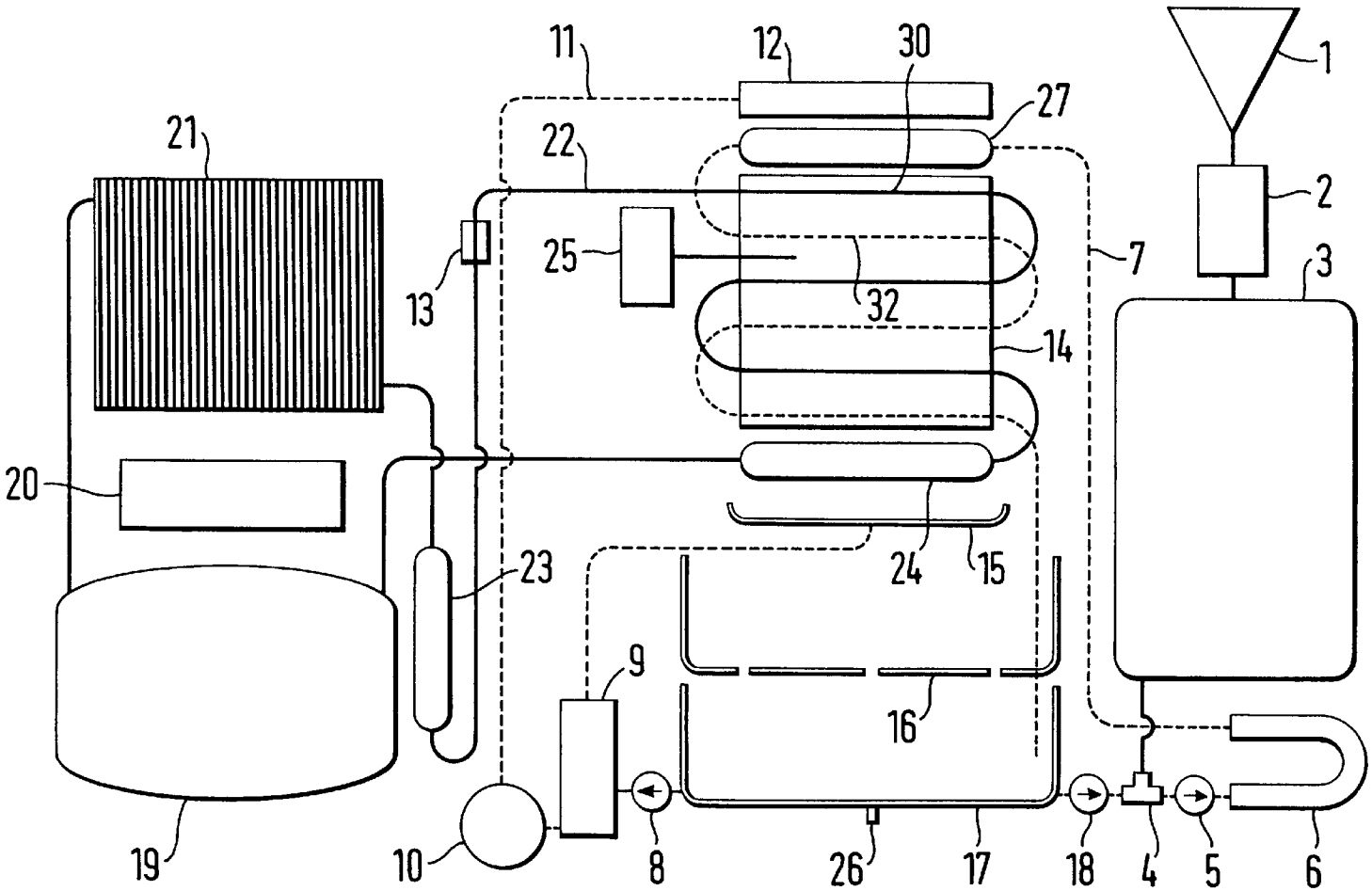

METHOD AND A MACHINE FOR TREATMENT OF WATER, ESPECIALLY WHEN PRODUCING ICE, PARTICULARLY ICE CUBES

The invention concerns a method for treatment of water, especially for freezing water to ice, particularly in the form of ice cubes, in a machine, where water is distributed over a freezing plate with cooling elements for cooling water and/or forming ice on the plate. The invention also concerns a machine for use in such treatment of water, especially an ice cube machine.

The production of ice is per se a conventional process, and there are a number of known designs of machines for producing ice cubes. Such ice cube machines have been used especially in hotels and restaurants where the consumption of ice cubes is high. Such machines are intended for more or less continuous operation, the machine usually being supplied with water directly from the mains and ensuring a regular replenishment of a storage container for the ice cubes. In the freezing process, water is distributed over a relatively large freezing surface, which means that a relatively large refrigeration system must be used for forming ice simultaneously over the entire surface. Most of the known devices of this type are relatively large and expensive and not particularly suitable for private households. Ice cube machines have also been developed in connection with refrigerators/freezers, where the freezer's refrigeration system is also utilised for the formation of ice cubes.

In U.S. Pat. No. 4,412,420 there is disclosed a machine for producing ice cubes where water is circulated along a freezing plate in a machine. The plate is equipped on both sides with a lattice of channels for circulation of a cooling medium and water pipes, thus forming hollows or moulds. The plate is placed vertically below a vessel with water from which water is supplied to the plate. Ice cubes will thus be formed in the hollows on both sides of the plate. When the ice cubes have to be loosened, the cooling medium is replaced with a heating medium, the water pipes are filled with water and this heating process causes the ice cubes to work loose and fall down into a container under the freezing plate.

U.S. Pat. No. 4,357,807 describes a machine for producing ice cubes where water runs over a inclined, flat freezing plate, where tubes are provided for the cooling medium on the bottom, thus forming a layer of ice on the plate. After a certain operating period the cooling medium is replaced with a heating medium, thus causing the plate to be heated and the bottom layer of ice melts, with the result that it slides down on a net consisting of a tube with a heating medium, which will divide the sheet of ice into cubes by melting the sections which are in contact with the net.

In both U.S. patents the water which does not freeze is recycled to the freezing plate's upper area. There is further disclosed in DE 2517942 a method for producing ice cubes where the ice cubes are made in moulds which are surrounded by tubes for a cooling medium. The ice cubes are loosened by means of hot water and forced out of the moulds by water under pressure which is introduced at the bottom of the moulds. This water is employed in a next stage for the formation of new ice cubes.

Most of the ice cube machines on the market to-day are, as mentioned above, connected to the water mains, since the water which has to be frozen should not be polluted before entering the ice making machine. Moreover, connection to the mains permits a process to be achieved which is as automatic as possible. A disadvantage of this kind of connection, however, will be that impurities which exist in the mains system will also enter the ice making machine. Furthermore, there is often a certain amount of air in the mains water, which can lead to air bubbles in the ice cubes which are formed.

This problem forms the basis for the invention as well as the desire to provide a water treatment, especially when freezing water to ice, particularly in the form of ice cubes, where the water will be as free as possible of pollution and bacteria. The object of the invention, therefore, is to provide a method by which a simple and rapid water treatment can be undertaken, especially in the production of pure ice, where the entrapment of air is avoided, thus providing ice which is "homogeneous" and transparent. A further object of the invention is to provide a machine which can treat water in a simple manner, especially in the production of ice of such quality. The machine should have sufficient capacity to satisfy the normal requirements of an ordinary family and should be so reasonable to purchase that it will be an alternative in the consumer goods sector. The machine should have a low energy consumption, should be service-friendly and mobile and in the standard version should not be connected to the water mains. The invention should also be able to be employed for cooling water down to the freezing point of water without the formation of ice cubes.

These objects are achieved by a method and a machine which are characterized by the features presented in the patent claims.

In the invention water which has been heated to a temperature near the boiling temperature (in the following called boiled water) is employed, wherein bacterial growth is partially killed and wherein at least some of the air is expelled. The water should thereby be heated at least to a temperature of approx. 80–100° C., and preferably as near as possible to he boiling temperature. Especially in the starting period of the process the temperature may be in the lower area. It may appear to be a self-contradiction that the water which has to be cooled or from which ice cubes have to be made, is exposed to a boiling process, but this can also have its advantages since the hot water in a circulation process can emit heat which can be used to free ice from the freezing plate. Thus during the circulation the boiled and partly sterilised water will be cooled and a uniform build-up of a layer of ice will be obtained on the freezing plate. During the freezing which takes place, any remaining impurities in the water will be exposed to the effect of cold and thereby to a further purification. It has been shown that the combination of heating to circa 80–100° C. with consequent cooling towards or below 0° C. provides a particularly efficient purification and removal of the bacterial flora. In principle water may be employed which is heated or boiled in a preceding stage, but the most advantageous procedure will be to incorporate the boiling process in the actual ice making machine. On start-up it may be advantageous to fill up with previously boiled water, thus enabling the machine to be operated with this until water has been boiled. The invention also comprises a machine for treatment of water, especially for cooling and/or producing ice, particularly ice cubes. The machine is preferably intended for use on a small scale, such as for household use and can be built as a mobile machine, which is independent of connection to a water mains system, with the result that the water which has to be frozen into ice cubes is taken from a storage container in the actual machine which can be replenished as it becomes empty. In the machine the water undergoes a boiling or sterilising process, thus avoiding bacteria and similar pollution in the water, while at the same time air is forced out to a great extent, thus giving the ice cubes a clear and compact consistency. In the machine according to the invention the heat from the boiling process is utilised for releasing the ice cubes after the completion of production on the freezing element, which is composed of a inclined plate. The method which is employed for operation of the apparatus, together with the design of the actual freezing element or the inclined plate is the object of Norwegian patent application 96 2830 and described in more detail therein.

Figure 2:
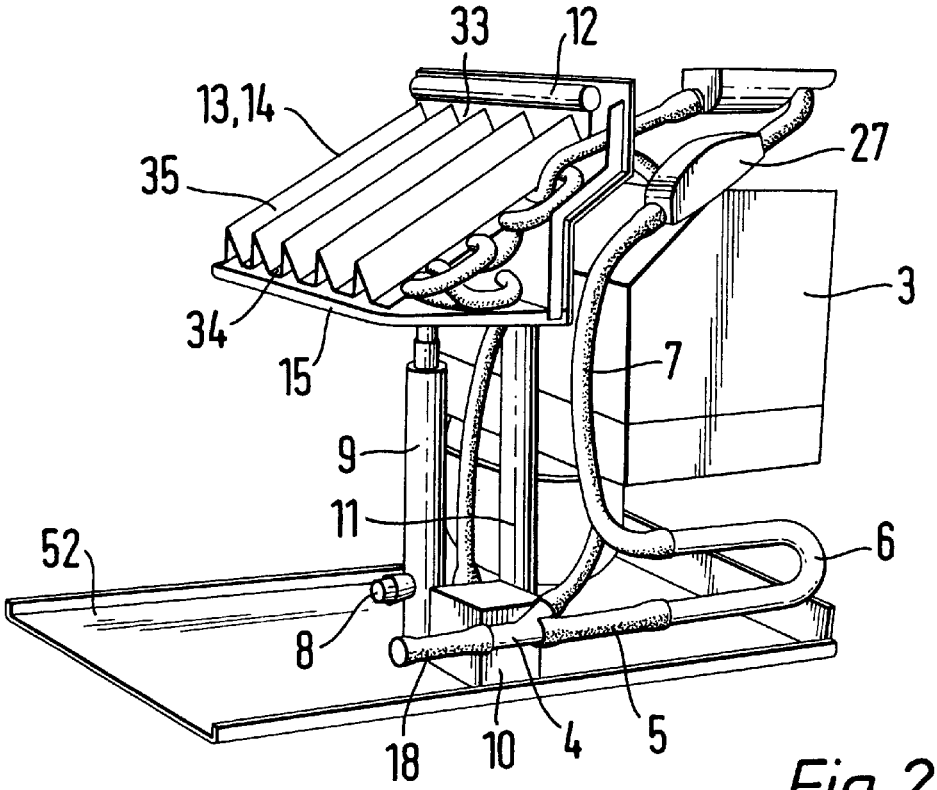
Figure 3:
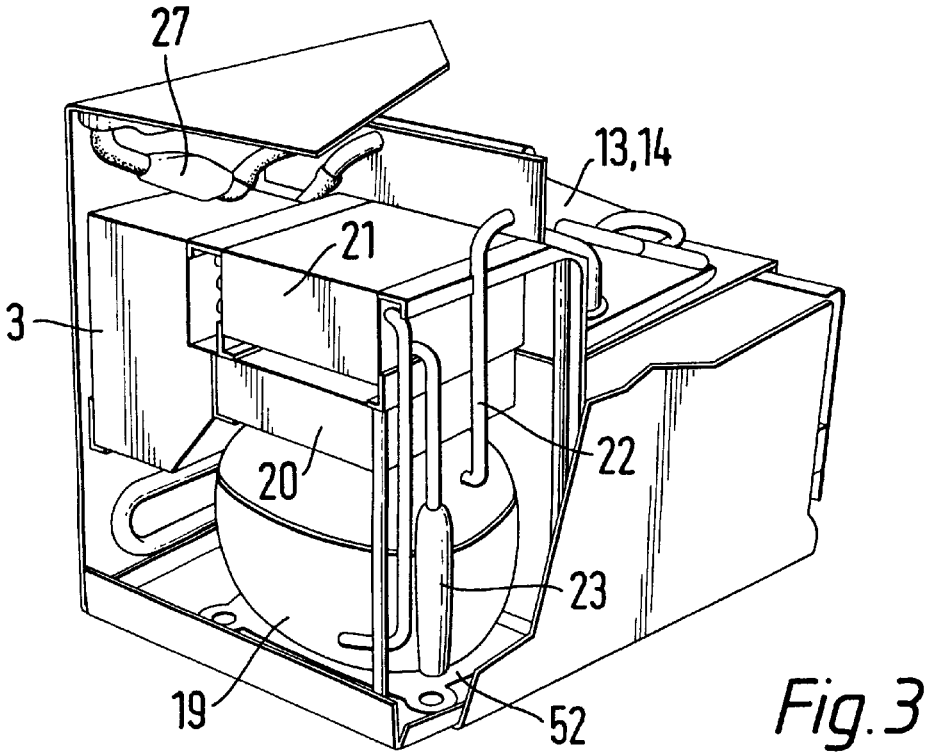
Figure 4:
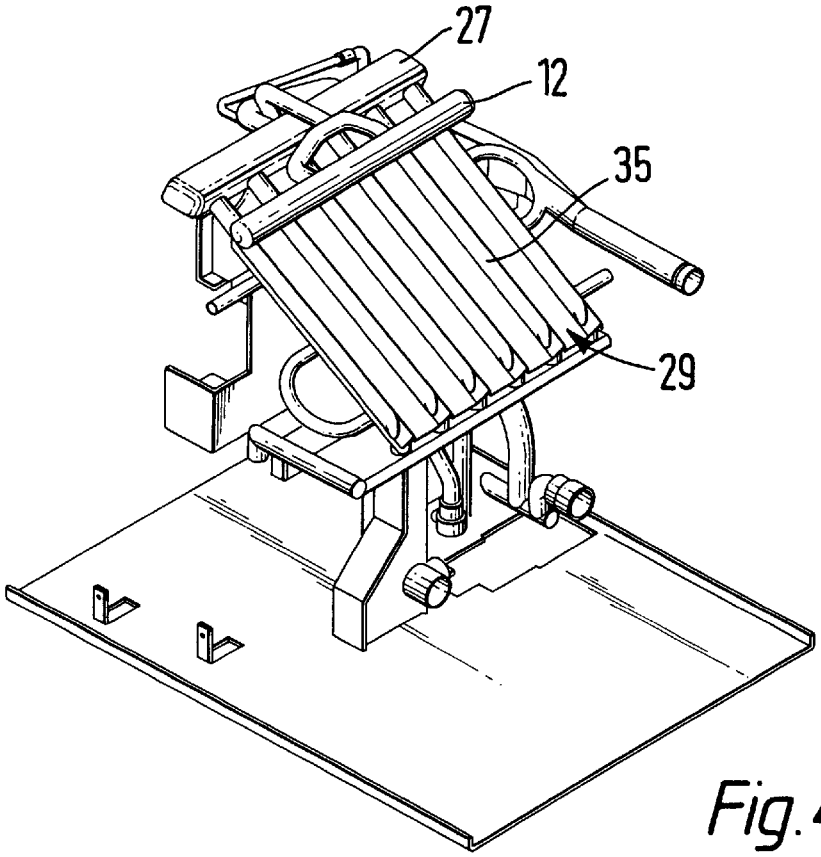
Figure 5:
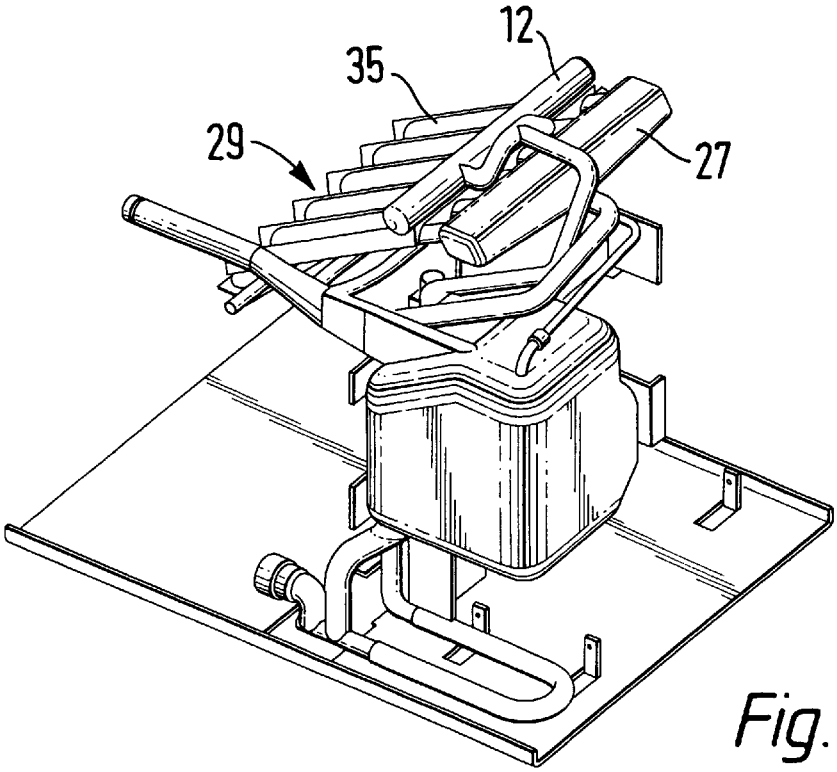

Further features of the invention will be presented in the claims and the following description of embodiments of ice making machines according to the invention with reference to the drawing, in which:

FIG. 1 is a schematic illustration of the production process,

FIG. 2 is a perspective view of an ice making machine according to the invention, in a first embodiment, with the cover removed, FIG. 3 is a perspective view of the ice making machine in FIG. 2, viewed from the opposite side, with the cover only partially cut away, FIG. 4 is a perspective view of a second embodiment of the invention, FIG. 5 is the embodiment in FIG. 4, viewed from the opposite side.

In order to facilitate understanding, the same reference numerals are used for corresponding parts in all the figures.

The embodiments which are illustrated in the drawing show how the principles of the method according to the invention are employed in an ice making machine, while at the same time the construction of a machine according to the invention is illustrated.

In FIG. 1, which is a purely schematic block diagram, the numeral 1 indicates a filling device for water. This may advantageously be funnel-shaped in order to facilitate filling. The water passes through a filter 2, which is intended to remove particles and any other substances which are dissolved in the water, depending on the filter type. The filter may be of a type which is either cleaned after a certain period of use or is replaceable. From the filter the water continues down into a storage tank 3 whose size is intended for a certain period of ice cube production. From the storage tank a tube goes to a coupling 4, which normally may be a Y tube or a T tube. From the coupling a tube passes through a non-return valve 5 to a heating device in the form of a heating or boiling element 6. From the boiling element a tube 7 continues to an expansion member 27 in the form of a container and/or a manifold, and thereafter to a system for distribution of a heating medium. In FIG. 1 this system is illustrated as a loop-shaped channel system, but it may also consist of a plurality of separate channels. The channels may be provided horizontally and/or vertically. Alternative designs are described below. The channels are arranged in close contact with a plate-shaped freezing element 14, where the formation of ice cubes is to take place. The outlet of the channel(s) is connected with a tube or the like which forms a connection to a collecting container 17 which is placed under a collecting tray 16 for ice cubes. The collecting tray has a perforated bottom. From the collecting container 17 a tube leads back to the coupling 4 via a non-return valve 18, and a second tube leads to a recycling vessel 9 via a non-return valve 8. A tube connects the recycling vessel 9 with a pump 10, which in turn is connected via a return tube 11 to a distributor tube 12 which is located at the top of the freezing element 14. Choice of pump type will be dependent on the location of the pump 10 in the circuit. In the example a supply pump is employed, but for a different location an extraction pump may also be employed. In the tube 11 there is further provided a choke body 13. Under the freezing element there is located a collecting tray 15, from which a tube leads down to the recycling vessel 9. A recyling circuit is thereby formed for water from the recycling vessel 9, through the pump 10, via the return tube 11 to the distribution tube 12, down along the freezing element 14, on to the collecting tray 15 and back to the recycling vessel. The figure also illustrates an outlet 26 which can be used for emptying and cleaning the machine.

The design of the freezing plate is not discussed in more detail here, since it is the object of the applicant's simultaneous Norwegian patent application .96 2830 refer to what is stated therein.

In the invention a standard refrigeration unit is employed, which is operated by a cooling medium and which consists of a compressor 19, a fan 20, a condenser 21, a drying filter 23, a choke body (e.g. in the form of capillary tubes or a thermostatic expansion valve) 13, the evaporator in the freezing element 14 and a heat exchanger 24. The actual freezing process for the ice cubes is of a conventional nature and is therefore not described more closely. The cooling medium circuit 22 consists of parallel evaporator tubes 30 which are connected in forward and backward-moving loops in close contact with the bottom of the bottom plate 29. The evaporator tubes 30 for cooling medium thus extend across the direction of fall, and will be located between the heating channels 32 in the embodiment in FIG. 2. The channels 30 form transverse freezing zones 31 in the freezer channels, located at a sufficient distance apart to prevent these freezing zones from merging with one another, but being separated by warmer zones where the water does not freeze. In FIG. 1 three channels 30 and thereby three freezing zones 31 are shown, but this number may be both larger and smaller.

The principles of ice cube production by means of a freezing plate as described in Norwegian patent application No. 96 2830 are also described in the said application and therefore not further described here. Refer again to patent application No. 96 2830.

FIGS. 2 and 3 are a perspective view of a practical design of an ice cube machine installed in a cabinet, which, however, is completely removed in FIG. 2 and partly removed in FIG. 3. The two perspective views illustrate the machine from opposite sides, so that all the machine's interior elements are visible in one or other of the figures. However, for the sake of simplicity, the filling device 1, the filter 2, the collecting tray for ice cubes 16 and the collecting container 17 are omitted. However, the non-return valve 8 for connection of the collecting container can be seen, thereby clearly illustrating that the collecting tray 15 is located above the collecting container 17, with the result that the water pressure will normally be higher in the recycling vessel 9 than in the collecting container. Furthermore, it can be seen that the storage tank 3 for water is also located higher than the collecting container, with the result that here too there is a static pressure difference as previously mentioned. The expansion container 27 is located above the storage tank 3, thus preventing cold water from the storage tank from flowing through the boiling element 6 and into the expansion container when the flow to the boiling element is not connected. The components are mounted on a chassis 52.

FIGS. 4 and 5 are two perspective views of the same kind as those illustrated in FIGS. 2 and 3, but of a second embodiment. The principal design is the same as in the first embodiment, but in this case, instead of heating channels 32 on the bottom of the bottom plate 29 of the freezing plate 14, the cavities in the partitions 35 have been used for transfer of the heating means. With the triangular design of the partition walls 35 either the internal cavity can be closed, forming channels directly, or tube elements can be inserted. The expansion chamber 27 is designed here as a manifold, distributing steam/hot water to the channels in the partition walls directly via branch tubes from the manifold. This provides a constructionally simpler design. In the drawing some of the construction elements are removed here too, in order to better illustrate the special features of this design.

In the above the invention has been described with reference to two special embodiments. It should be understood, however, that it will be possible to design a number of elements in the illustrated embodiments differently without departing from the scope of protection according to the claims. The design of the freezing plate 14, e.g., can be varied as it is described in Norwegian patent application No. 96 2830. As a heating or boiling element 6 other solutions may also be used than those which are described. Thus it is conceivable, if the ice machine is to be employed in a location without a power supply, that it can be designed for gas operation, both with regard to boiling of the water as well as for the actual refrigeration system. Moreover, solutions can be envisaged where the entire heating circuit or parts thereof in the area of the freezing element are replaced by electrical heating. Hot gas may also be used in heating elements, possibly in combination with hot water from the boiling device. These are alternatives to the use of boiled water as explained above.

Other simplified solutions may also be envisaged in relation to the illustrated embodiment. For example, the recycling vessel, the expansion container, the filter and the filling funnel may be omitted. The collecting tray may be simplified to a grating, the collecting tray may be replaced by a channel at the bottom of the bottom plate, the distribution tube may be designed as a part of the bottom plate, and the collecting container and the storage tank may be combined to form one tank, while at the same time the coupling 4 and the non-return valve 5, 8 and 18 are omitted. All of these variants are intended to fall within the scope of the invention.

It should also be particularly emphasized that the use of a combined boiling and freezing of water is not restricted to the illustrated embodiment for the apparatus, the principle being generally applicable independent of the design of the apparatus.

What is claimed is:

1. A method for treating water, comprising the steps of:

providing a heating device, and a cooling plate having cooling elements;

passing water from a storage structure through the heating device;

heating the water in the heating device to a temperature in the general region of the boiling temperature of the water, thereby purifying the water; and cooling the water by passing it over the cooling plate, whereby cooled water or ice is formed.

2. The method according to claim 1, wherein said heating step comprises heating the water in the heating device to between approximately 80° C. and 100° C.

3. The method according to claim 1, wherein said heating step comprises heating the water in the heating device to approximately 100° C.

4. The method according to claim 1, wherein said cooling step further comprises cooling the water sufficiently to form ice.

5. The method according to claim 4, said method further comprising the step of releasing the ice from the cooling plate by passing hot water from the heating device through channels of the cooling plate.

6. An apparatus for treating water, comprising:

storage structure for storing water;

a cooling plate, said cooling plate having cooling elements;

a circulation circuit having a heating element for heating water from said storage structure to a temperature in the region of the boiling temperature of the water, thereby purifying the water, wherein said heating element is located between said storage structure and a supply to said cooling plate;

a distribution device, said distribution device distributing water from said circulation circuit over said cooling elements, thereby forming at least one of cooled water and ice; and collecting structure for collecting said at least one of cooled water and ice formed by said cooling elements.

7. The apparatus according to claim 6, further comprising a heating member having at least one channel, said heating member proximate to said cooling elements; and wherein said heating member causes the release of ice formed by said cooling elements onto said cooling plate.

8. The apparatus according to claim 7, further comprising an expansion container between said heating element and said heating member, through which water heated by said heating element passes.

9. The apparatus according to claim 8, wherein said expansion container comprises a manifold, wherein said manifold distributes water which has been heated by said heating element through substantially longitudinal channels.

10. The apparatus according to claim 6, wherein said storage structure is operatively connected to a main water supply.

* * * * *